United States Patent [19]

Auth et al.

[11] Patent Number: 4,872,906

[45] Date of Patent: Oct. 10, 1989

[54] PROCESS AND PLANT FOR PRODUCING BINDER-FREE HOT BRIQUETTES

[75] Inventors: Rudolf Auth, Dorsten; Lothar Seidelmann, Duisburg; Heinz Maas, Dinslaken, all of Fed. Rep. of Germany

[73] Assignee: Thyssen Stahl AG, Duisburg, Fed. Rep. of Germany

[21] Appl. No.: 168,708

[22] Filed: Mar. 16, 1988

[30] Foreign Application Priority Data

Apr. 2, 1987 [DE] Fed. Rep. of Germany ..... 3711130

[51] Int. Cl.[4] ..... C22B 1/24

[52] U.S. Cl. ..... 75/5; 75/256

[58] Field of Search ..... 75/256, 26, 4, 3, 5; 266/81

[56] References Cited

U.S. PATENT DOCUMENTS

| | | | |
|---|---|---|---|
| 3,870,507 | 3/1975 | Allen | 75/4 |
| 4,533,384 | 8/1985 | Rellermeyer et al. | 75/5 |
| 4,645,184 | 2/1987 | Rellermeyer et al. | 266/81 |

FOREIGN PATENT DOCUMENTS 1818874 2/1970 United Kingdom .

*Primary Examiner*—Scott Kastler

*Attorney, Agent, or Firm*—Sprung Horn Kramer & Woods

[57] ABSTRACT

The invention relates to a process for producing binder-free hot briquets of finely particulate non-pyrophoric residual substances accumulating in the production and processing of iron and steel and containing substantially no combustible components, for use in smelting. The characterizing features of the invention are: fuel in a finely particulate form is admixed to the residual substances; a quantity of sensible heat is fed from outside to the mixture of residual substances and fuel, until the fuel ignites, the quantity of fuel added being such that the temperature of the residual substances reaches the range of 600° to 900° C.; and the residual substances are then immediately hot-briquetted without intermediate cooling at a temperature in the aforementioned range.

13 Claims, 2 Drawing Sheets

PROCESS AND PLANT FOR PRODUCING BINDER-FREE HOT BRIQUETTES

Figure 1:
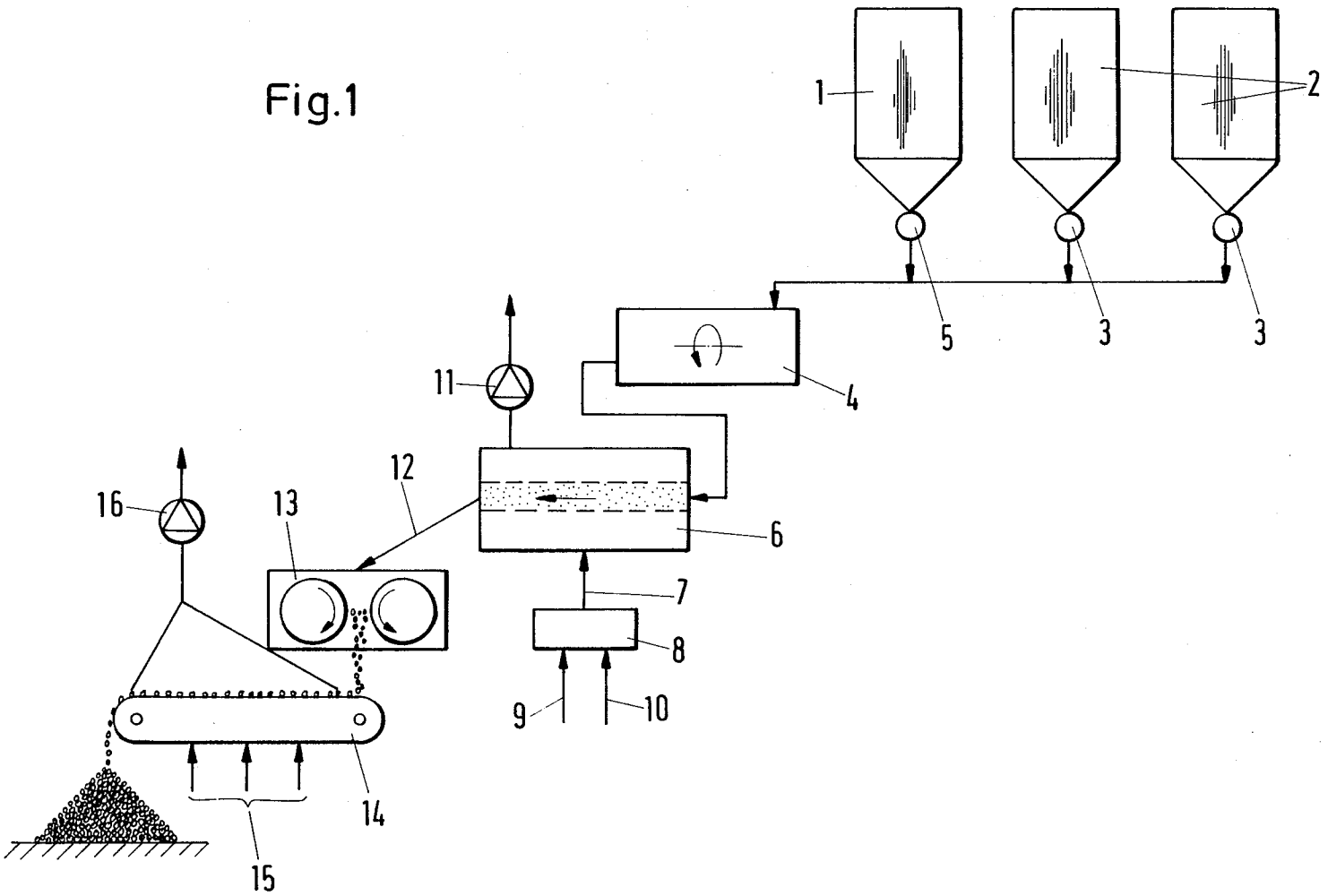

The invention relates to a process and plant for making binder-free hot briquets of finely particulate non-pyrophoric residual substances accumulating in the production and processing of iron and steel and containing substantially no combustible components, for use in smelting.

The residual substances are finely particulate dusts, slurries, granulates and other substances which contain iron oxides or other metal oxides, such as blast furnace filter dust, oxygen converter filter dust removed from the workshops of steel works, electric furnace filter dust, steel works filter slurries, etc. An attempt is made in the iron and steel industry to cycle the residual substances accumulating back into the production process in order to recover to valuable components contained in the residual substances; however, in many cases this is very difficult or even impossible, due to the texture of the residual substances, more particularly their finely particulate nature. Often the only remaining possibility is then to dump these residual substances, thus causing environmental problems.

It is known to briquette ordinary filter dusts by using binding agents to enable them to be reused, the binding agents used being substances such as, for example, bitumen and other tar products, molasses and sulphite liquor. The disadvantage of these binding agents is that by their presence they reduce the concentration of the valuable components in the briquette product and often introduce impermissible impurities such as, for example, sulphur, for subsequent processing or create environmental problems. Since they are required in large quantities, the costs accruing from the price of the binding agent itself, transportation and storage costs and a number of other cost factors are considerable, thus making the economics of the process doubtful.

German Patent Specifications No. 32 23 203 and 35 29 084 disclose processes for making binder-free hot briquettes from residual substances, but by such processes only those residual substances can be hot-briquetted without a binding agent which consist either completely or at least mainly of pyrophoric material (metallic iron); the temperature of the finely particulate residual substances is raised to 450° to 650° C. by oxidizing a proportion of the metallic iron. German Patent specification No. 35 29 084 also discloses the substitution of fuel for up to 15% of the pyrophoric finely particulate solids.

As regards the aforementioned residual substances which mainly contain no combustible substances, engineers in the art hitherto took the view as shown, for example by German AS No. 15 33 827, that the hot briquetting temperature should be adjusted by heat supplied from outside. However, a hot briquetting temperature in the range of 600° to 900° C. means that he associated plant for heating the substances must be designed for even higher temperatures, so that the plant becomes expensive and complicated.

It is an object of the invention to obviate the aforementioned disadvantages and provide a process and associated plant by means of which even residual substances substantially containing no combustible components can be processed into binder-free hot briquettes.

This process is solved by the process having characteristic features as follows:

In the process according to the invention a finely particulate fuel is admixed to the finely particulate residual substances. Sensible heat is then supplied from outside to the cold mixture until the fuel ignites. Due to the relatively low temperature level, the heat can be supplied economically. In contrast, the high hot briquetting temperatures of 600 to 900° C., which are difficult to adjust, are reached by the heat evolved in the combustion of the admixed fuel; since the combustion heat can be transmitted without heavy losses directly to the finally particulate residual substances, this process step can be performed economically.

The performance is advantageously performed in a moving bed/fluidized bed or in a rotary tube .

The fuels advantageously used, such as anthracite high temperature coke, anthracite coke, pit coal coke and anthracite or pit coal slags should have a low ignition temperature (250°-450° C.), to keep to a minimum the quantity of sensible heat supplied from outside until the fuel ignites.

The proportion of fuel in the mixture of residual substances and fuel, which is 2 to 10% by weight, and preferably 4 to 6% by weight, should be such that the fuel is substantially consumed before the start of hot briquetting of the heated residual substances. An excess carbon content is permissible only on condition that the kind of fuel used has no adverse effect on hot briquetting.

The quantity of fuel added is also determined by the calorific value of the fuel and depends on the properties of the particular residual substance such as, for example, water content and specific heat capacity.

When processing filter dusts from oxygen top-blown converters, care should be taken that the free lime content of the dusts caused by the process does not exceed 8%. With higher lime contents it is to be expected that the briquets will tend to disintegrate due to the absorbtion of atmospheric humidity followed by hydration. The disadvantages of increased free lime contents might be compensated only by apreciably raising the briquetting temperature or raising the roller pressure, but this would also have a disadvantageous effect on the economies of the process.

In a preferred embodiment (FIG. 13) additional sensible heat is fed from outside to the mixture of finely particulate residual substances and fuel even after the fuel has started to burn, to produce the briquetting temperature of 600° to 900° C. at an accelerated rate.

Advantageous plants for the performance of the process comprise a mixer, a moving/fluidized bed or a rotary tube, a combustion chamber for producing a hot oxidizing gas flow with supply to the moving/fluidized bed, a briquetting press, and a cooling conveyer It is regarded as an advantage of the invention that it provides a solution to the problems connected with the processing of residual substances which contain substantially no combustible components, and that such residual substances can be heated to hot briquetting temperature in an energy-saving manner. Another advantage is that relatively cheap fuels can be used, and moreover the plant is thermally less heavily loaded for heating the finely particulate residual substances and can therefore be designed more cheaply.

Figure 2:
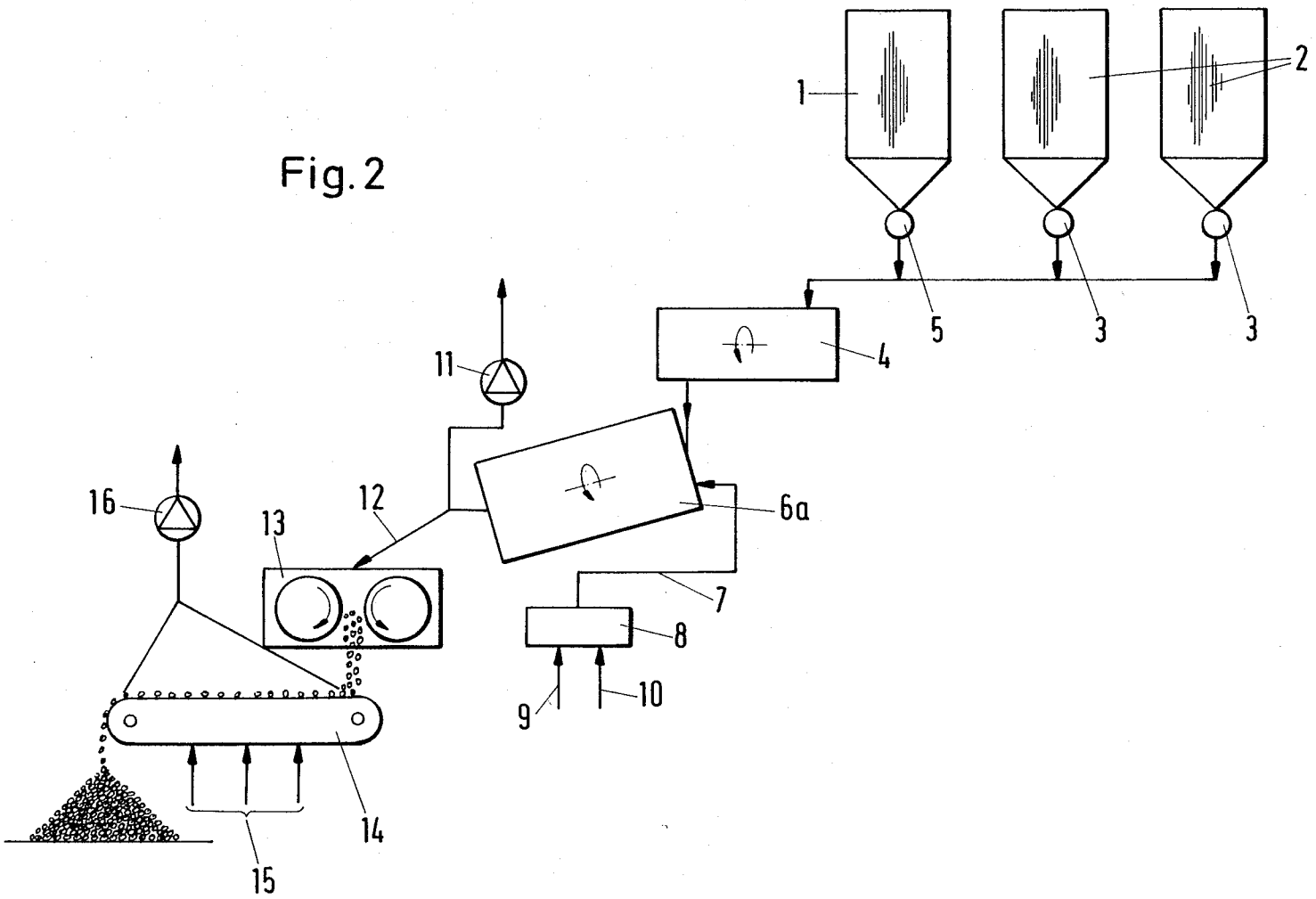

An embodiment of the process and plant according to the invention will now be described in greater detail with reference to the drawings, wherein:

FIG. 1 shows the binder-free hot briquetting of residual substances according to the invention using a fluidized bed, and FIG. 2 shows the hot briquetting of residual substances according to the invention using a rotary tube.

As FIG. 1 shows, the residual substances to be briquetted are stored in silos 2. The finely particulate residual substance is conveyed via a discharge device 3 to a mixer 4. Finely particulate fuel is fed from a silo 1 via a metering device 5 and mixed with the finely particulate residual substance in the mixer 4.

Sensible heat is supplied from outside by a hot oxidizing gas flow 7, which also acts as a fluidizing gas flow, to the mixture of fuel and finely particulate residual substance in a fluidized bed 6. The hot oxidizing gas flow 7 is produced in a combustion chamber 8 from combustion gas 9 and air 10.

After the ignition temperature of the fuel has been reached it reacts with the oxidizing gas flow; the combustion heat evolved heats the finely particulate residual substance as it moves over the fluidized bed, so that at the end of the bed it has the hot briquetting temperature. Then the heated residual substance 12 is fed directly to a briquetting press 13 and pressed into hot briquets. The hot briquets are cooled to storage temperature by surrounding air 15 from a fan 16 on a following cooling conveyer 14. The outgoing air occurring above the fluidized bed is fed by a blower 11 to a dust removal device (not shown).

In FIG. 2 the place of the fluidized bed 6 is taken by a rotary tube 6a into which the hot oxidizing gas flow 7 is introduced.

The values shown in the following Table provide a further explanation of the invention:

| | Example | | |
|---|---|---|---|
| | 1 Filter dust | 2 Dried coarse slurry | 3 Steel works dust |
| Chemical Analysis: | | | |
| $Fe^{++}$—$Fe^{+++}$ content | 21% | 72% | 63% |
| Chromium content | 13% | | |
| Ni + Mn content | 9% | | |
| Ca O content | 5% | 5% | 3% |
| Residual moisture | <1% | 10% | <1% |
| Fuel additive: | | | |
| Anthracite | 6% | 7% | 5% |
| Hot briquetting temperture | 800° C. | 700° C. | 750° C. |
| Briquetting at a roller pressure (kN/cm roller width) | 100 kN/cm | 100 kN/cm | 100 kN/cm |
| Cooling of briquets on a cooling conveyer | 50° C. | 40° C. | 60° C. |
| Quality of the briquets: | | | |
| (a) Bulk density | 4 g/cm³ | 5.2 g/cm³ | 4 g/cm³ |
| (b) Cold compressive-strength | 200–500 daN | 200–500 daN | 200–500 daN |
| Further processing | briquet iron works | briquet steel works | briquet steel works |

The filter dust of Example 1 comes from the filter installation of a special steel works with electric furnace and AOD converter, the coarse slurry of Example 2 was separated in the filter installation of an oxygen steel works with wet dust removal, and the steel works dust of Example 3 comes from the room dust removal system of an oxygen steel works.

We claim:

1. A process for the production of binder-free hot briquets of finely particulate non-pyrophoric residual substances accumulating in the production and processing of iron and steel and containing substantially no combustible components, for use in smelting, wherein :
   a) fuel in a finely particulate form is admixed to the residual substances,
   b) a quantity of external heat is fed from outside to the mixture of residual substances and fuel, until the fuel ignites, the quantity of fuel added being such that the temperature of the residual substances reaches the range of 600° to 900° C., and
   c) the residual substances are then immediately hot-briquetted without intermediate cooling at a temperature in the aforementioned range.

2. A process according to claim 1, wherein
   a) the external heat is fed to the mixture of residual substances and fuel in a moving bed, or fluidized bed, or moving, fluidized bed by a hot oxidizing gas flow which at the same time acts as a fluidizing gas flow,
   b) after the ignition point has been reached, the fuel is burnt by means of the oxidizing hot gas flow, and the heated residual substances are hot-briquetted immediately after leaving the moving bed, or fluidized bed, or moving, fluidized bed.

3. A process according to claim 2, wherein the mixture of residual substances and fuel remains in the moving bed, fluidized bed, or moving, fluidized bed for 5 to 30 minutes.

4. A process according to claim 1, wherein
   a) the external heat is fed to the mixture of residual substances and fuel in a rotary tube by a hot oxidizing gas flow blown into the rotary tube,
   b) after the ignition point has been reached, the fuel is burnt by means of the oxidizing hot gas flow, and
   c) the heated residual substances are hot-briquetted immediately after leaving the rotary tube.

5. A process according to claim 4, wherein the mixture of residual substances and fuel remains in the rotary tube for 5 to 30 minutes.

6. A process according to claim 5, wherein at least one of anthracite and pit coal in the form of coke or slack are used as fuels.

7. A process according to claim 6, wherein the grain size of the of the fuels used is up to 5 mm.

8. A process according to claim 6, wherein the grain size of the fuels used is 0.5 to 1.5 mm.

9. A process according to claim 1, wherein the proportion of fuel in the mixture of residual substances and fuel is 2 to 10% by weight.

10. A process according to claim 9, wherein the proportion of the fuel is 4 to 6% by weight.

11. A process according to claim 10, wherein the grain size of the finely particulate residual substances is up to 5 mm.

12. A process according to claim 11, wherein the grain size of the finely particulate residual substances is smaller than 1 mm.

13. A process according to claim 12, wherein even after the combustion of the fuel has started, additional external heat is fed from outside to the mixture of finely particulate residual substances and fuel, to reach the briquetting temperature of 600° to 900° C. at a quicker rate.

* * * * *

UNITED STATES PATENT AND TRADEMARK OFFICE

CERTIFICATE OF CORRECTION

PATENT NO. : 4,872,906

DATED : October 10, 1989

INVENTOR(S) : Auth et al.

It is certified that error appears in the above-identified patent and that said Letters Patent is hereby corrected as shown below:

| | |
|---|---|
| Title Page, under "Inventors" | Insert --Ursula Christine Kaas, Heiress of the late Werner Kaas, Burchestr. 173, 4220 Dinslakenen-- |
| Col. 4, line 44 | Delete "claim 5" and substitute --claim 1-- |
| Col. 4, line 47 | Delete "claim 6" and substitute --claim 1-- |
| Col. 4, line 49 | Delete "claim 6" and substitute --claim 1-- |
| Col. 4, line 56 | Delete "claim 10" and substitute --claim 1-- |
| Col. 4, line 62 | Delete "claim 12" and substitute --claim 1-- |

Signed and Sealed this

Twenty-ninth Day of September, 1992

*Attest:*

DOUGLAS B. COMER

*Attesting Officer*

*Acting Commissioner of Patents and Trademarks*